US005993242A

United States Patent [19]

Zell et al.

[11] Patent Number: 5,993,242

[45] Date of Patent: Nov. 30, 1999

[54] MULTI-POLE FEMALE STRIP CONNECTOR AND METHOD FOR MAKING CONTACT WITH A MULTI-POLE MALE STRIP CONNECTOR

[75] Inventors: Karl Zell, Niederpöcking; Jürgen Seibold, Baierbrunn; Peter Seidel, Gröbenzell, all of Germany

[73] Assignee: Siemens Aktiengesellschaft, Munich, Germany

[21] Appl. No.: 09/043,588

[22] PCT Filed: Sep. 10, 1996

[86] PCT No.: PCT/DE96/01700

§ 371 Date: Mar. 20, 1998

§ 102(e) Date: Mar. 20, 1998

[87] PCT Pub. No.: WO97/11512

PCT Pub. Date: Mar. 27, 1997

[30] Foreign Application Priority Data

Sep. 21, 1995 [DE] Germany ..... 195 35 108

[51] Int. Cl.[6] ..... H01R 4/24

[52] U.S. Cl. ..... 439/394; 439/579; 439/404; 439/417

[58] Field of Search ..... 439/579, 400, 439/397, 399, 404, 405, 394, 417

[56] References Cited

U.S. PATENT DOCUMENTS 4,790,775 12/1988 David ..... 439/579

5,385,490 1/1995 Demeter et al. ..... 439/579

FOREIGN PATENT DOCUMENTS 0 284 245 9/1988 European Pat. Off. .

0 285 860 10/1988 European Pat. Off. .

0 418 045 3/1991 European Pat. Off. .

2041372 1/1971 France .

*Primary Examiner*—Paula Bradley

*Assistant Examiner*—Tho D. Ta

*Attorney, Agent, or Firm*—Hill & Simpson

[57] ABSTRACT

The present invention relates to a method for making contact with a multipole female strip connector for plug connections with coaxial connecting cables. In order to simplify the method and to save tools, a multi-row female strip connector is split into plastic disks, one side of the disk having insulation-piercing terminals which are arranged one behind the other and are connected to contact springs, and the other side having correspondingly formed, overmolded pressure pieces. The disks are held spaced apart in a pressing tool by means of corresponding press-in pins which have a force fit. Coaxial connecting cables, which are cut to length and at whose free ends the outer insulation and the shield mesh have been removed over a predetermined length, are pushed into these disks, which are preassembled spaced apart. When the disks are pressed together, the pressure pieces press the connecting wires into the insulation-piercing terminal.

15 Claims, 4 Drawing Sheets

A-B

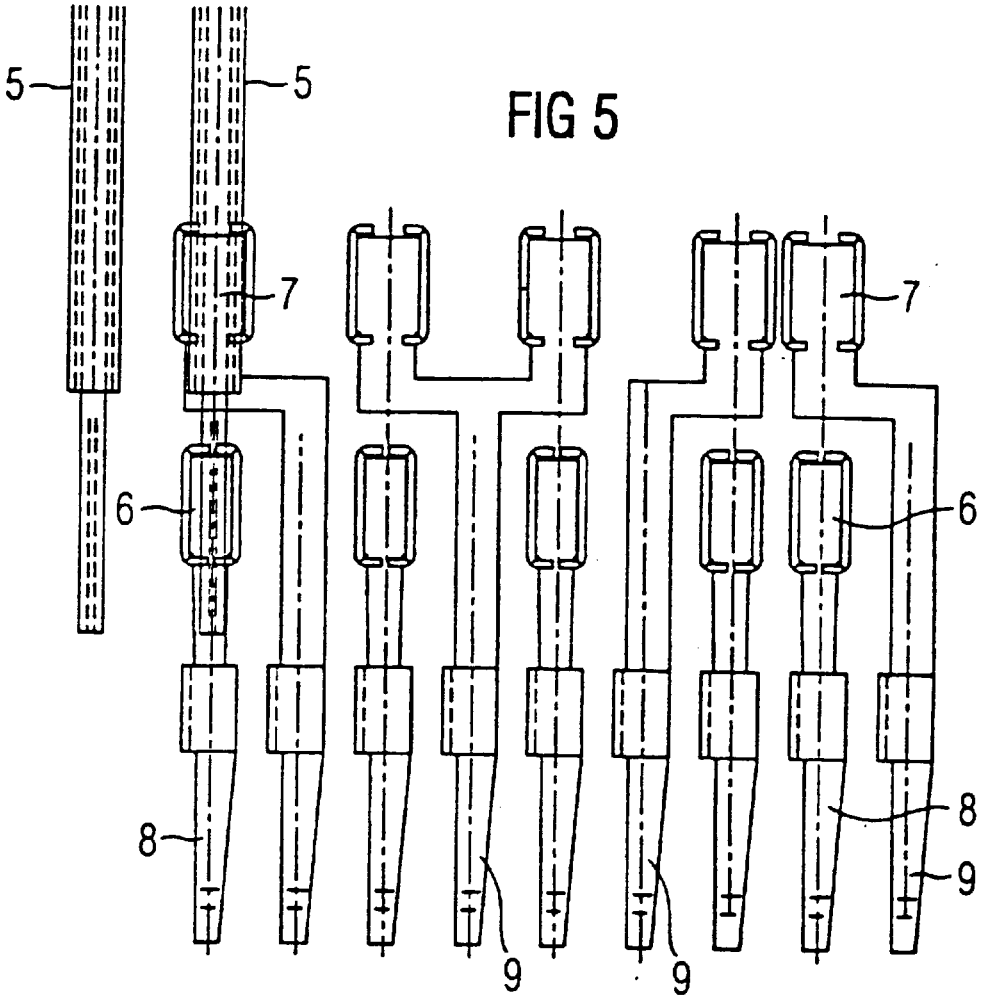
FIG 5
FIG 6
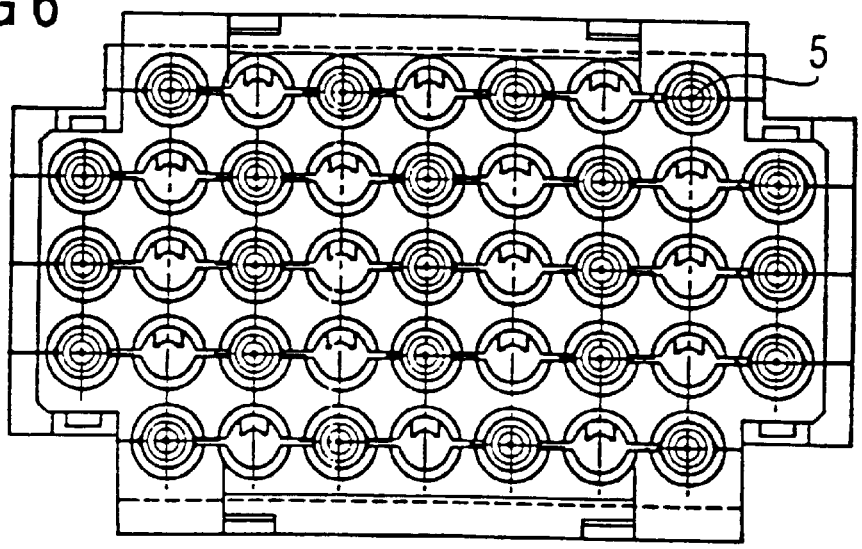

MULTI-POLE FEMALE STRIP CONNECTOR AND METHOD FOR MAKING CONTACT WITH A MULTI-POLE MALE STRIP CONNECTOR

FIELD OF THE INVENTION

The present invention relates to a method for making contact with a multipole female strip connector for plug connections with coaxial connecting cables.

BACKGROUND OF THE INVENTION

In the case of the known female strip connectors, special coaxial connectors, which occupy a relatively large amount of space, are snapped in when high connective quality is required. A further disadvantage of these connectors is that they interfere with the standard connector geometry. In the case of less stringent quality requirements, the inner conductor is provided with a normal crimped spring, and the shield is clamped on the metallic housing. If it is intended to shield coaxial junctions using an intermediate grid size, the shield must be separated out, twisted to form a conductor, and likewise has a crimped spring attached. All the methods mentioned here are complex and expensive and demand complex special tools or manual activities.

The object of the present invention is to specify a method for making contact with a multipole female strip connector for plug connections with coaxial connecting wires, which method can be carried out easily and is not as complex as the known methods.

SUMMARY OF THE INVENTION

In the method of the present invention, this object is achieved as claimed in the invention by the female strip connector being composed of a plurality of plastic disks which are designed in such a manner that at least a first of their sides is designed to accommodate insulation-piercing terminals and contact springs which are integrally connected to them.

In each case one insulation-piercing terminal for the inner conductor and one insulation-piercing terminal for the shield mesh, are arranged in alignment one behind the other, for each coaxial connecting cable.

The insulation-piercing terminals for the inner conductors and the associated contact springs are arranged in alignment one behind the other.

The insulation-piercing terminals for the shield mesh are connected via a cross-connection to shield contact springs which are arranged alongside the contact springs for the inner conductors, an opposing second side of each disk has correspondingly formed overmolded pressure pieces which are used to press the inner conductors and the shield meshes into the respective insulation-piercing terminals.

Therefore, of the two opposite sides of each disk, one side has receptacles for pressing pins which are fitted on the other side.

The plastic disks which are preassembled with the insulation-piercing terminals and contact springs held spaced apart within a pressing tool by the pressing pins, which are designed to be a force fit.

The coaxial connecting wires, which are cut to length and have free inner conductors at their ends, are pushed into these plastic disks, which are preassembled spaced apart, in the insertion direction of the female strip connector.

The plastic disks are pressed together by means of the pressing tool.

The method as claimed in the invention has the advantage that it can be carried out easily, since there is no need to use special connectors, or special, complex method steps.

In accordance with the present invention, a method for making contact between a multi-pole female strip connector for plug connections in a plurality of coaxial connecting cables is provided. The method includes the steps of providing a disconnected female strip connector comprising a plurality of adjacent plastic disks including a plurality of internal plastic disks arranged in a parallel and aligned fashion between a pair of opposing first and second external plastic disks. Each internal plastic disk includes two opposing sides including a first side that is connected to two spaced-apart insulation-piercing terminals. The first side of each internal plastic disk also is connected to two contact springs, one contact spring being connected to each insulation-piercing terminal. The second opposing side of each internal plastic disk comprises at least two spaced-apart pressure members. The external disks each have the characteristic of one side of the internal disks. For example, a first external plastic disk will include two spaced-apart pressure members and a second external plastic disk will include two spaced-apart insulation-piercing terminals and two corresponding contact springs. A plurality of coaxial cables is placed between two of the plastic disks so that the inner conductor is in alignment with a lower insulation-piercing terminal of one disk and the lower pressure member of an adjacent disk and so that the sheath conductor is in alignment with the upper insulation-piercing terminal of the one disk and the upper pressure member of the adjacent disk. The method finally includes the steps of pressing the first and second external plastic disks together so that the lower pressure members of the internal plastic disks and of the first external plastic disk press the inner conductors of the cables into the lower insulation-piercing terminals of the internal plastic disks or the second external plastic disk and, consequently, so that the upper pressure members of the internal plastic disks and the first external plastic disk press the sheath conductors of the cables into the upper insulation-piercing terminals of the internal plastic disks or second external plastic disk.

In an embodiment, the upper and lower insulation-piercing terminals each comprise an insulation piercing region. Further, the upper and lower pressure members each comprise spaced-apart pairs of pressure members with one of the pressure members being in alignment with the insulation piercing region of its respective insulation-piercing terminal and the other member of the pair being aligned outside of the insulation piercing region of its respective insulation-piercing terminal.

In an embodiment, the pressure members that fall outside of the insulation piercing regions comprise a curved surface which encloses about one-half of the circumference of its respective cable.

In an embodiment, the pressure members that fall inside of the insulation piercing regions of their respective insulation-piercing terminals comprise a trough-shaped depression.

In an embodiment, one of the sides of the internal plastic disks and one of the external plastic disks comprise at least one press pin and the opposing sides of the internal plastic disks and the other external plastic disk comprise a receptacle for matably receiving the press pins in an interference fit.

Advantageous refinements of the method as claimed in the invention result from the dependent claims and from the following description of a female strip connector which is illustrated in the drawing and in which the method as claimed in the invention is used.

BRIEF DESCRIPTION OF THE DRAWINGS

In the drawing,

FIG. 5 illustrates various arrangements of the insulation-piercing terminals and contact springs for the shield mesh, FIG. 6 illustrates a wiring example for the contact springs in the female strip connector.

Figure 1:
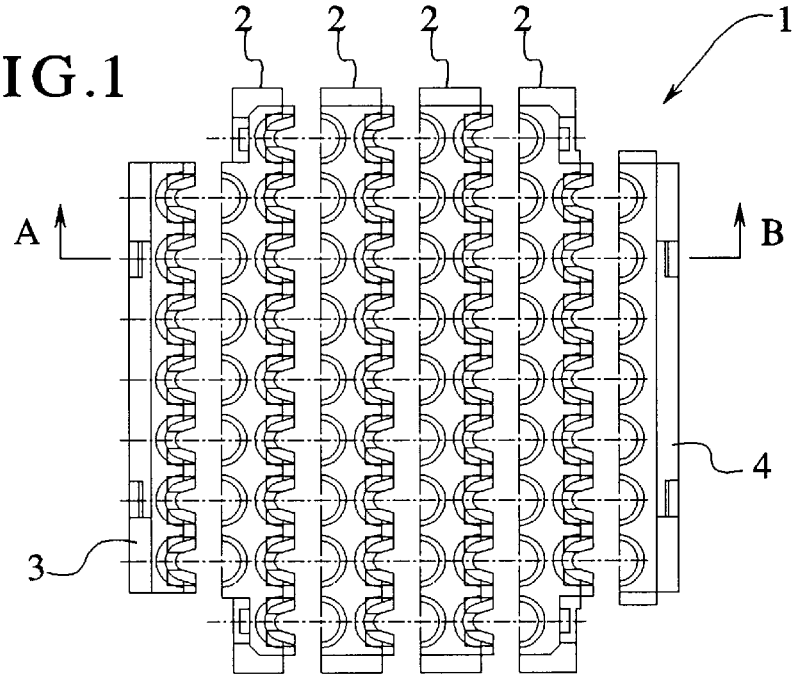
FIG. 1 is a plan view of a fitted female strip connector, in which the method as claimed in the invention is used, before the plastic disks have been pressed together.
Figure 2:
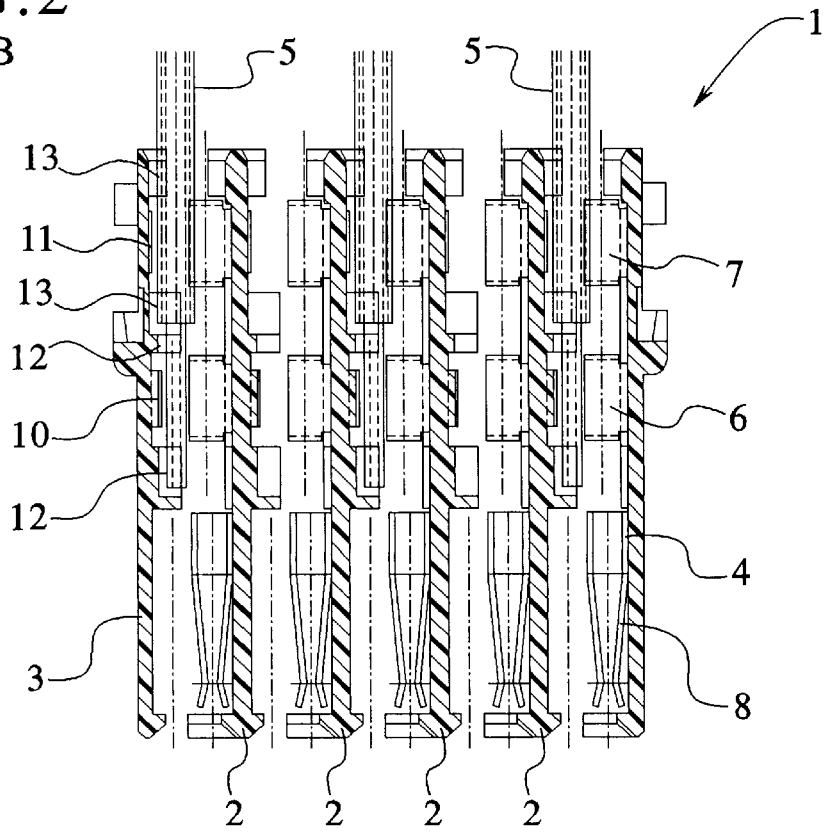
FIG. 2 is a cross sectional view A–B through FIG. 1.
Figure 3:
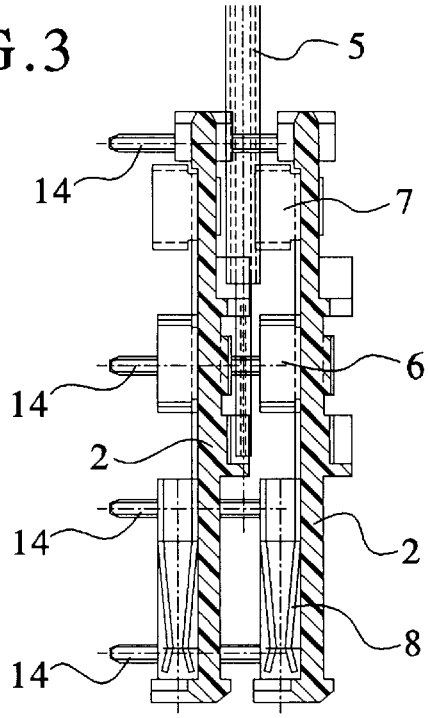
FIG. 3 is a cross sectional view through FIG. 1, in which the pressing pins can be seen.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

The female strip connector 1 in which the method as claimed in the invention is used comprises the plastic disks 2, 3, 4, the plastic disks 2 being inner plastic disks which are all designed identically. The plastic disks 3 and 4 are outer plastic disks 4. For purposes of clarity, the outer disk 3 is referred to as the first outer disk and the outer disk 4 is referred to as the second outer disk. These plastic disks each have a smooth surface on one of their sides, which smooth surfaces at the same time form outer surfaces of the female strip connector 1.

The plastic disks 2 are designed on a first side in such a manner that they accommodate the insulation-piercing terminals 6 and 7 and the contact springs 8 and 9 which are connected to them. In this case, the lower insulation-piercing terminals 6 are used for connection of the inner conductors of the coaxial connecting cables 5 to be connected, and are in each case connected to the contact springs 8. The upper insulation-piercing terminals 7 are used for connection of the shield mesh of the coaxial connecting cable, and are in each case connected to the contact springs 9. As can be seen from FIG. 5, in order to connect the coaxial connecting cable, it is only necessary to remove the outer insulation and the shield mesh at the free end of the cable that is to be connected.

Overmolded pressure pieces or members 10 to 13 are fitted on the other or second side of the plastic disks 2. Of these pressure pieces, the pressure pieces 10 and 11 are located inside the insulation-piercing terminal regions of the insulation-piercing terminals 6 and 7, while the pressure pieces 12 and 13 are respectively located on the two sides, outside the insulation-piercing terminal regions of the insulation-piercing terminals 6 and 7.

The pressure pieces 12 and 13 which are arranged outside the terminal regions are designed in such a manner that they enclose virtually 180° of the connecting cables 5 and their insulated inner conductors and in this way form a guide for insertion of the connecting wires 5 (which has been prepared as described above) into the preassembled and spaced-apart plastic disks 2, and furthermore prevent the connecting cables 5 from being bent while they are being pressed together. In consequence, the pressure surface of the pressures pieces 10 and 11 which are located inside the insulation-piercing terminal regions of the insulation-piercing terminals 6 and 7 is formed by a slight trough-shaped depression for applying high pressure while they are being pressed together.

Furthermore, one side of the plastic disks 2 is in each case provided with pressing pins 14 which engage in receptacles (not shown) on the opposite side. The pressing pins 14 have a force fit. In the case of the illustrated female strip connector 1, the pressing pins 14 are located on that side of the plastic disks 2 on which the pressure pieces 10 to 13 are located.

The statements made above apply in a corresponding manner to the outer plastic disks 3 and 4. The actual contact-making process will now be described.

First of all, the individual plastic disks 2 are fitted with the insulation-piercing terminals 6 and 7 and the contact springs 8 and 9, the insulation-piercing terminals 6 and the contact springs 8 as well as the insulation-piercing terminals 7 and the contact springs 9 in each case forming a unit. The plastic disks 2, 3 and 4 are then placed against one another. Since the pressing pins 14 have a force fit, the plastic disks are kept at a predetermined distance from one another as long as no real pressure is exerted by the pressing tool.

The connecting cables 5, which have been cut to length and have been prepared as described above, are then inserted from above, between these plastic disks 2, 3, 4 (which have been preassembled and are held spaced apart) in the insertion direction of the female strip connector 1. Once the connecting cables 5 have been inserted, the plastic disks are pressed together by means of a simple pressing tool. This completes the contact-making process.

In the case of the method as claimed in the invention, the pressure pieces 10 to 13 take over the function of the contact-making tool which is required in addition for the known contact-making method. In addition, there is no need for additional use of a crimping tool in the case of the method as claimed in the invention.

Figure 4:
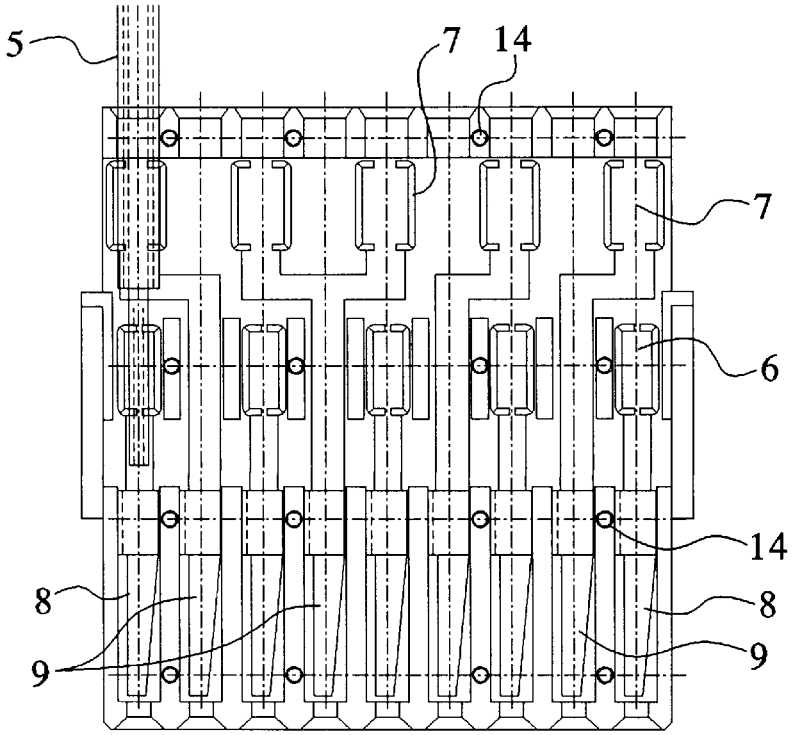
FIG. 4 is a longitudinal sectional view through a female strip connector in which the method as claimed in the invention is used.
Figure 7:
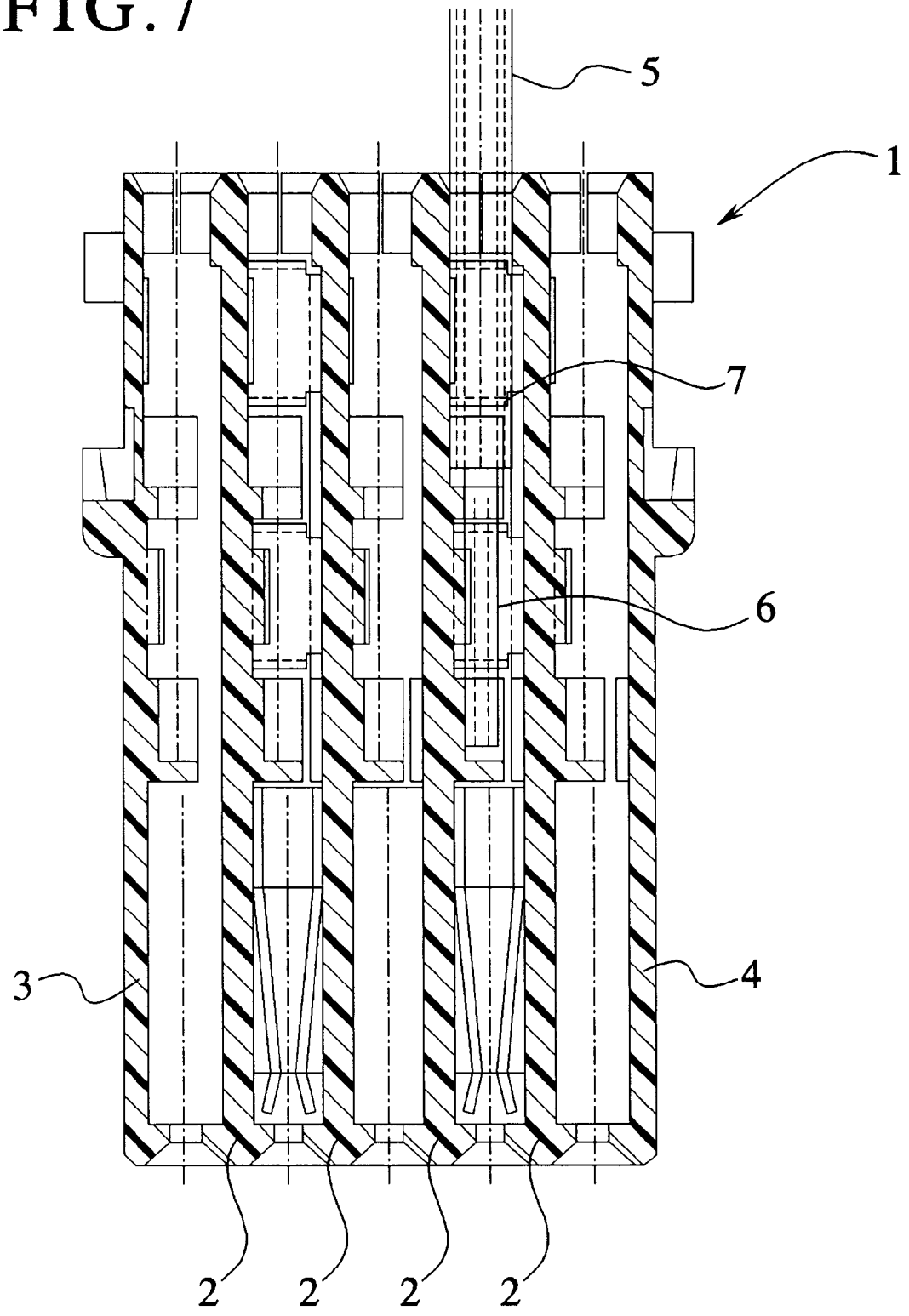
FIG. 7 is a cross sectional view through a female strip connector in which the method as claimed in the invention is used, after the plastic disks have been pressed together.

As can be seen in FIGS. 4 to 6, the configuration of the connection between the insulation-piercing terminals 7 for the shield mesh of the connecting cable 5 and the contact springs 9 which are conductively connected to them can be designed differently, FIG. 6 illustrating just one exemplary solution. The configuration may be designed such that in each case one or more contact springs 8 which carry the actual signal are surrounded by contact springs 9 which carry the shield potential.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

We claim:

1. A method for making contact between a multi-pole female strip connector for plug connections and a plurality of coaxial connecting cables, the method comprising the following steps:

providing a disconnected female strip connector comprising a plurality adjacent plastic disks including a plurality of internal plastic disks arranged in a parallel and aligned fashion between a pair of opposing first and second external plastic disks, each internal plastic disk comprising two opposing sides including a first side that is connected to two spaced-apart insulation-piercing terminals including an upper insulation-piercing terminal and a lower insulation-piercing terminal, the first side of each internal plastic disk also being connected to two contact springs including a first contact spring and a second contact spring, the first contact spring being connected to the upper insulation-piercing terminal, the second contact spring being connected to the lower insulation-piercing terminal, the second side of each internal plastic disk comprising at least two spaced-apart pressure members including an upper member and a lower member, and the first external plastic disk comprising two spaced-apart pressure members including an upper member and a lower member, the second external plastic disk being connected to two spaced-apart insulation-piercing terminals including an upper insulation-piercing terminal and a lower insulation-piercing terminal, the second external plastic disk also being connected to two contact springs including a first contact spring and a second contact spring, the first contact spring being connected to the upper insulation-piercing terminal of the second external plastic disk, the second contact spring being connected to the lower insulation-piercing terminal of the second external plastic disk, providing a plurality of coaxial cables, each cable comprising an inner conductor, a sheath conductor, placing the coaxial cables between said plastic disks so that the inner conductor of each cable is in alignment with the lower insulation-piercing terminal of one disk and the lower pressure member of an adjacent disk, and so that the sheath conductor is in alignment with the upper insulation-piercing terminal of one disk and the upper pressure member of the adjacent disk, pressing the first and second external plastic disks together with the internal plastic disks and coaxial cables disposed therebetween so that the lower pressure members of the internal plastic disks and the first external plastic disk press the inner conductors of the cables into the lower insulation-piercing terminals of adjacent internal plastic disks or the second external plastic disk and so that the upper pressure members of the internal plastic disks and the first external plastic disk press the sheath conductors of the cables into the upper insulation-piercing terminals of adjacent internal plastic disks or the second external plastic disk.

2. The method of claim 1 wherein the first sides of the internal plastic disks and the first external plastic disk comprise at least one press pin and the second sides of the internal plastic disks and the second external plastic disk comprise at least one receptacle for matably receiving the press pins of the first sides of the internal plastic disks and the first external plastic disk in an interference fit.

3. The method of claim 1 wherein the second sides of the internal plastic disks and the second external plastic disk comprise at least one press pin and the first sides of the internal plastic disks and the first external plastic disk comprise at least one receptacle for matably receiving the press pins of the second sides of the internal plastic disks and the second external plastic disk in an interference fit.

4. The method of claim 1 wherein the upper and lower insulation-piercing terminals each comprise an insulation piercing region, the upper and lower pressure members each comprise spaced-apart pairs of pressure members with one of the members of the pair being in alignment with the insulation piercing region of one of the insulation-piercing terminals and the other member of the pair being aligned outside of the insulation piercing region of the one of the insulation-piercing terminals.

5. The method of claim 4 wherein the other members of the pairs of pressure members that fall outside of the insulation piercing regions comprise a curved surface, the cables further comprising a circumference, the curved surface of the other members enclosing about one-half of circumference of one of the cables.

6. The method of claim 4 wherein the members of the pairs of pressure members that fall inside the insulation piercing regions comprise a trough-shaped depression.

7. A multi-pole female strip connector for making contact between a plug connection and a plurality of coaxial connecting cables, the cables including an inner conductor and a sheath conductor, the female strip connector comprising:

a plurality adjacent plastic disks including a plurality of internal plastic disks arranged in a parallel and aligned fashion between a pair of opposing first and second external plastic disks, each internal plastic disk comprising two opposing sides including a first side that is connected to two spaced-apart insulation-piercing terminals including an upper insulation-piercing terminal and a lower insulation-piercing terminal, the first side of each internal plastic disk also being connected to two contact springs including a first contact spring and a second contact spring, the first contact spring being connected to the upper insulation-piercing terminal, the second contact spring being connected to the lower insulation-piercing terminal, the second side of each internal plastic disk comprising at least two spaced-apart pressure members including an upper member and a lower member, and the first external plastic disk comprising two spaced-apart pressure members including an upper member and a lower member, the second external plastic disk being connected to two spaced-apart insulation-piercing terminals including an upper insulation-piercing terminal and a lower insulation-piercing terminal, the second external plastic disk also being connected to two contact springs including a first contact spring and a second contact spring, the first contact spring being connected to the upper insulation-piercing terminal of the second external plastic disk, the second contact spring being connected to the lower insulation-piercing terminal of the second external plastic disk, the lower pressure members of the internal plastic disks and the first external plastic disk pressing the inner conductors of the cables into the lower insulation-piercing terminals of adjacent internal plastic disks or the second external plastic disk and the upper pressure members of the internal plastic disks and the first external plastic disk pressing the sheath conductors of the cables into the upper insulation-piercing terminals of adjacent internal plastic disks or the second external plastic disk.

8. The female strip connector of claim 7 wherein the first sides of the internal plastic disks and the first external plastic disk comprise at least one press pin and the second sides of the internal plastic disks and the second external plastic disk comprise at least one receptacle for matably receiving the press pins of the first sides of the internal plastic disks and the first external plastic disk in an interference fit.

9. The female strip connector of claim 7 wherein the second sides of the internal plastic disks and the second external plastic disk comprise at least one press pin and the first sides of the internal plastic disks and the first external plastic disk comprise at least one receptacle for matably receiving the press pins of the second sides of the internal plastic disks and the second external plastic disk in an interference fit.

10. The female strip connector of claim 7 wherein the upper and lower insulation-piercing terminals each comprise an insulation piercing region, the upper and lower pressure members each comprise spaced-apart pairs of pressure members with one of the members of the pair being in alignment with the insulation piercing region of one of the insulation-piercing terminals and the other member of the pair being aligned outside of the insulation piercing region of the one of the insulation-piercing terminals.

11. The female strip connector of claim 10 wherein the other members of the pairs of pressure members that fall outside of the insulation piercing regions comprise a curved surface, the cables further comprising a circumference, the curved surface of the other members enclosing about one-half of circumference of one of the cables.

12. The female strip connector of claim 10 wherein the members of the pairs of pressure members that fall inside the insulation piercing regions comprise a trough-shaped depression.

13. A multi-pole female strip connector for making contact between a plug connection and a plurality of coaxial connecting cables, the cables including an inner conductor and a sheath conductor, the female strip connector comprising:

a plurality adjacent plastic disks including a plurality of internal plastic disks arranged in a parallel and aligned fashion between a pair of opposing first and second external plastic disks, each internal plastic disk comprising two opposing sides including a first side that is connected to two spaced-apart insulation-piercing terminals including an upper insulation-piercing terminal and a lower insulation-piercing terminal, the upper and lower insulation-piercing terminals each comprising an insulation piercing region, the first side of each internal plastic disk also being connected to two contact springs including a first contact spring and a second contact spring, the first contact spring being connected to the upper insulation-piercing terminal, the second contact spring being connected to the lower insulation-piercing terminal, the second side of each internal plastic disk comprising at least two spaced-apart pairs of pressure members including an upper pair of pressure members and a lower pair of pressure members, and the first external plastic disk comprising at least two spaced-apart pairs of pressure members including an upper pair of pressure members and a lower pair of pressure members, and the second external plastic disk being connected to two spaced-apart insulation-piercing terminals including an upper insulation-piercing terminal and a lower insulation-piercing terminal, the upper and lower insulation-piercing terminals each comprising an insulation piercing region, the second external plastic disk also being connected to two contact springs including a first contact spring and a second contact spring, the first contact spring being connected to the upper insulation-piercing terminal of the second external plastic disk, the second contact spring being connected to the lower insulation-piercing terminal of the second external plastic disk, one of the lower pressure members of each internal plastic disk and the first external plastic disk pressing the inner conductors of the cables into the insulation piercing region of the lower insulation-piercing terminals of adjacent internal plastic disks or the second external plastic disk and one of the upper pressure members of the internal plastic disks and the first external plastic disk pressing the sheath conductors of the cables into the insulation piercing region of the upper insulation-piercing terminals of adjacent internal plastic disks or the second external plastic disk, the other members of the pairs of upper and lower pressure members being aligned outside of the insulation piercing region, the other members of the pairs of pressure members that fall outside of the insulation piercing regions comprising a curved surface, the cables further comprising a circumference, the curved surface of the other members enclosing about one-half of circumference of one of the cables.

14. The female strip connector of claim 13 wherein the first sides of the internal plastic disks and the first external plastic disk comprise at least one press pin and the second sides of the internal plastic disks and the second external plastic disk comprise at least one receptacle for matably receiving the press pins of the first sides of the internal plastic disks and the first external plastic disk in an interference fit.

15. The female strip connector of claim 13 wherein the second sides of the internal plastic disks and the second external plastic disk comprise at least one press pin and the first sides of the internal plastic disks and the first external plastic disk comprise at least one receptacle for matably receiving the press pins of the second sides of the internal plastic disks and the second external plastic disk in an interference fit.

* * * * *